US005505071A

United States Patent [19]

Hall, Jr. et al.

[11] Patent Number: 5,505,071

[45] Date of Patent: Apr. 9, 1996

[54] APPARATUS AND METHOD FOR RETENTION OF THIN FOILS DURING FORMING

[75] Inventors: Herbert L. Hall, Jr., Newark; Margaret M. Woodside, Pickerington; Stanley J. Rusek, Jr., Newark, all of Ohio

[73] Assignee: Owens-Corning Fiberglas Technology, Inc., Summit, Ill.

[21] Appl. No.: 239,158

[22] Filed: May 6, 1994

[51] Int. Cl.[6] ..... B21D 24/04

[52] U.S. Cl. ..... 72/350

[58] Field of Search ..... 72/347, 348, 350, 72/351, 60, 63

[56] References Cited

U.S. PATENT DOCUMENTS

| | | | |
|---|---|---|---|
| 2,422,883 | 6/1947 | Bruderlin . | |
| 2,745,173 | 5/1956 | Janos . | |
| 3,789,649 | 2/1974 | Clowes . | |
| 4,748,837 | 6/1988 | Kurosawa et al. | 72/63 |
| 4,833,903 | 5/1989 | de Smet | 72/350 |
| 5,090,981 | 2/1992 | Rusek, Jr. . | |
| 5,094,899 | 3/1992 | Rusek, Jr. . | |
| 5,376,424 | 12/1994 | Watanabe . | |

FOREIGN PATENT DOCUMENTS

| | | | |
|---|---|---|---|
| 3151382 | 12/1981 | Germany . | |
| 85620 | 5/1982 | Japan | 72/347 |

*Primary Examiner*—Lowell A. Larson

*Attorney, Agent, or Firm*—C. Michael Gegenheimer; Ted C. Gillespie

[57] ABSTRACT

A pair of forming elements incorporate features which restrain a thin foil workpiece without requiring high or excessive clamping pressures. A retaining step is provided in the second forming element having the forming cavity. It has been found that thin foil workpieces bent over and engaged by contact with the retaining step are secured against slippage with reduced clamping pressures. Moreover, the thin foil workpieces exhibit material draw during forming without the excessive lateral pressure between clamping surfaces that causes wrinkles. Substantially wrinkle-free flanges remain in the formed article.

20 Claims, 4 Drawing Sheets

APPARATUS AND METHOD FOR RETENTION OF THIN FOILS DURING FORMING

TECHNICAL FIELD

This invention relates to the forming of thin foils and, more specifically, to an apparatus and method for preventing wrinkles in flanges of thin foil materials during forming operations.

BACKGROUND OF THE INVENTION

Conventional room temperature forming operations experience difficulties in forming very thin sheet materials without wrinkles or tears, particularly in flange areas. Where desirable results without wrinkling or tearing have been obtained with conventional methods, high speed forming of thin sheet materials is limited to thicker materials for economical production levels. For example, using conventional room temperature forming methods, aluminum sheet material less than 0.0127 centimeters (cm) (0.005 inches [in]) thick is difficult to form without wrinkles or tears. As well, high speed forming of stainless steel by conventional means has been limited to sheets 0.0254 cm (0.010 in) thick or greater.

One of the problems associated with the forming of very thin gauge materials is the lack of adequate control over workpiece slip or draw while at the same time preventing the formation of wrinkles within the flange. The tendency of the thin workpiece material is to draw into the forming tool which causes the foil to be compressed laterally in the flange region. Insufficient clamp pressure or imperfect flatness between the two mating halves of the tool results in a buckling mode type of failure of the foil which produces wrinkles. However, excessive clamping force required to prevent excessive foil movement does not solve the problem of wrinkling, as some material draw is desirable. Excessive clamping force also promotes tearing of the foil during forming. For many forming applications, for example, vacuum insulation panels, wrinkle-free flanges are required for welding vacuum tight seams. Thus, generally, wrinkling is undesirable. Tearing is unacceptable.

Accordingly, the need exists for improved apparatuses and methods for forming very thin sheet materials without buckling, wrinkling or tearing of the flange area.

SUMMARY OF THE INVENTION

The present invention satisfies that need with a pair of forming elements which incorporate features which restrain a thin foil workpiece without requiring high or excessive clamping pressures. It has been found that when thin foil workpieces are secured against excessive slippage with reduced clamping pressures as taught in accordance with the present invention, the thin foil workpieces exhibit material draw during forming without the excessive lateral compressive pressure between clamping surfaces that causes wrinkles. Substantially wrinkle-free flanges remain in the formed article.

In accordance with the apparatus and method of the present invention, a pair of forming elements, referred to as first and second forming elements, are used to form a thin foil workpiece. The second forming element has a second clamping surface to receive the thin foil workpiece, a forming cavity bounded by the second clamping surface, and a retaining step defining the outer boundary of the second clamping surface. The retaining step includes an edge over which a thin foil workpiece is bendable. The edge is, thus, outside the forming cavity or cavities of the second forming element. The first forming element has a first resilient surface shaped such that when the first and second forming elements are in opposing relationship, portions of the first resilient surface are in opposing relationship with portions of the second clamping surface. When the first and second forming elements are in opposing relationship, portions of the first resilient surface also extend outward beyond the retaining step.

When the first and second forming elements are moved into clamping relationship, a thin foil workpiece placed between them is caused to bend over the edge of the retaining step. At the moment of die closure the foil is bent to the same sharp radius as the edge radius of the retaining step. This mechanical interlocking of the thin foil workpiece with the second forming element effectively reduces the clamping force required to retain the foil material against slippage during forming. As a result, substantially wrinkle-free flanges remain in the formed article, and the need for excessive lateral pressure to control material movement and prevent wrinkles in flange areas using conventional methods is eliminated.

A further benefit of reduced clamping pressures is that the lower clamping pressures on the flanges of formed shapes produce less stress in the foil. As well, larger foil workpieces may be used for a press of given tonnage, and thin foil workpieces have been produced into shapes which are several feet on a side, larger than is possible with some conventional methods, such as hydroforming. Retention against slippage provided by the retaining step also eliminates the use of cull plates, known in prior art techniques for protecting sheets and foils during forming. Thus, larger, higher quality shapes may be made more cost-effectively.

In summary, with reduced clamping force the first resilient surface bends the workpiece over the retaining step, forms a seal on the workpiece, and prevents buckling and wrinkling.

In the preferred embodiment, the second forming element includes a retaining step which extends downward from the second clamping surface and forms a generally sharp edge therewith over which the thin foil workpiece is bendable. In addition, the second forming element further includes a land area adjoining the retaining step and extending outward therefrom. The second forming element land area acts as a stop, thereby ensuring good clamping action by the opposing portions of the first resilient and second clamping surfaces, while at the same time preventing premature damage to the elastomeric surface by over-compression. Preferably the land area is positioned further from the first forming element than the second clamping surface.

In addition, in the preferred embodiment, the first resilient surface is a sheet of elastomer having a thickness approximately two to five times the height of the retaining step. Use of a resilient surface makes possible relaxation of the dimensional tolerances of the forming elements. Rather than requiring expensive, highly planar metal clamping surfaces, slight irregularities in the second clamping surface are tolerated by the resiliency of the first resilient surface. As well, for similar reasons use of a resilient surface further relieves the tolerances required for alignment of opposing forming elements. The position of the resilient surface may also be shifted from time to time relative to the second forming element to prevent excessive wear on one portion of the surface, lengthening its service life. Tool costs for the first and second forming elements are thereby reduced from those required for matched metal clamping. These and other features and advantages of the present invention are disclosed in the drawings and detailed description which follow.

DETAILED DESCRIPTION OF THE PREFERRED EMBODIMENTS

The apparatus and method of the present invention may be used to produce formed shapes from thin foil workpieces having substantially wrinkle-free flanges, as representatively shown in FIGS. 1 through 5.

Figure 1:
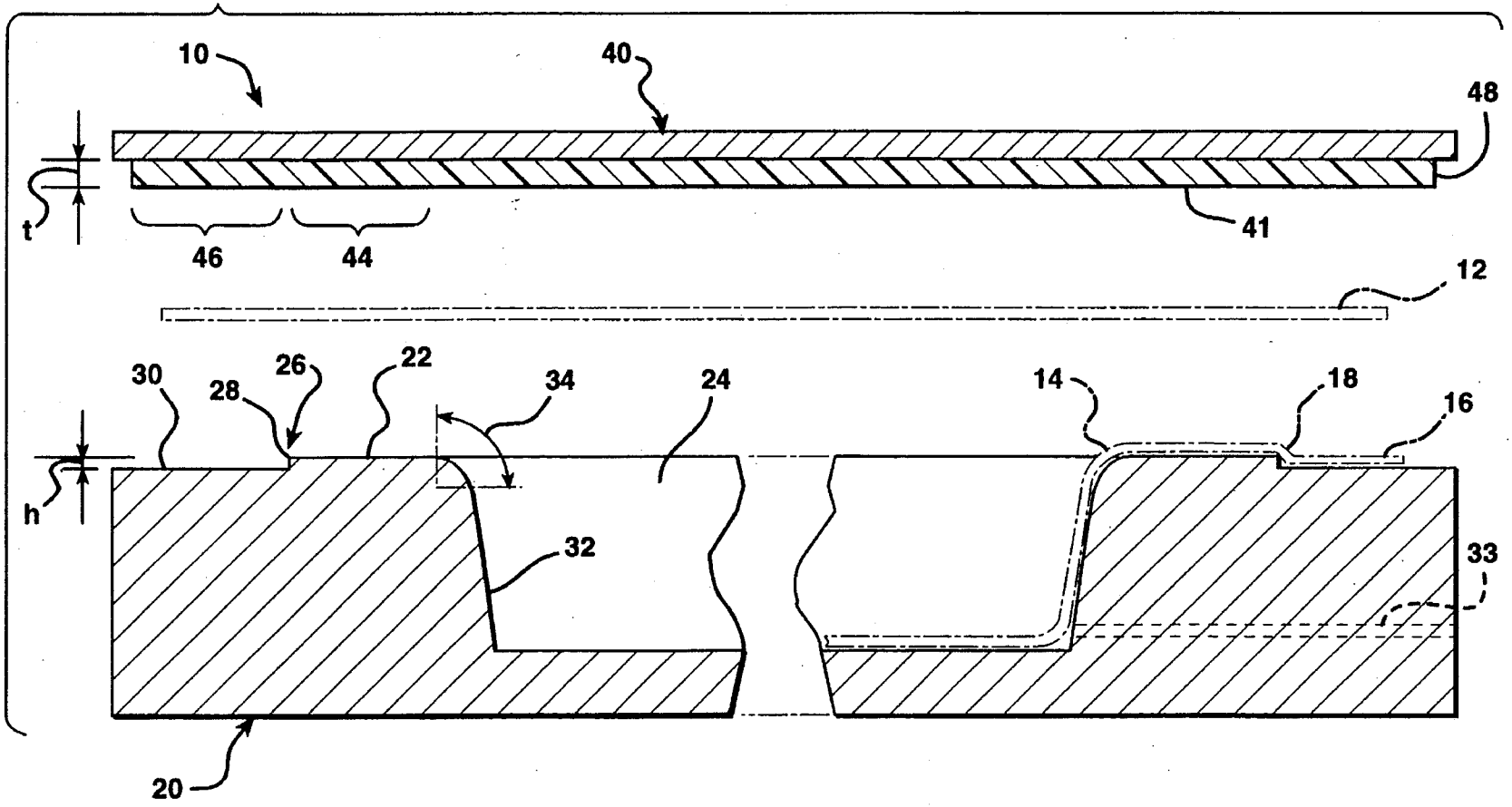
FIG. 1 is a schematic view in cross-section of the preferred embodiment of the present invention, with a representative forming cavity.

Referring to FIG. 1, in accordance with the apparatus 10 and method of the present invention, a pair of forming elements 40, 20 used to form a thin foil workpiece 12 are provided which include a second forming element 20 and a first forming element 40. As used herein, the term, "thin foil workpiece", is defined as made of material, typically metallic, of a thickness generally 0.0254 cm (0.010 in) or less. The second forming element 20 has a second clamping surface 22 to receive the thin foil workpiece 12, a forming cavity 24 bounded by the second clamping surface 22. In accordance with the present invention a retaining step 26 is further provided which defines the outer boundary of the second clamping surface 22. The retaining step 26 includes an edge 28 over which a thin foil workpiece 12 is bendable. The edge 28 is, thus, outside the forming cavity 24 or cavities of the second forming element 20. The first forming element 40 has a first resilient surface 41 shaped such that when the first and second forming elements 40, 20 are in opposing relationship, portions (generally indicated at 44) of the first resilient surface 41 are in opposing relationship with portions of the second clamping surface 22. When the first and second forming elements 40, 20 are in opposing relationship, portions (generally indicated at 46) of the first resilient surface 41 also extend outward beyond the retaining step 26.

Figure 3A:
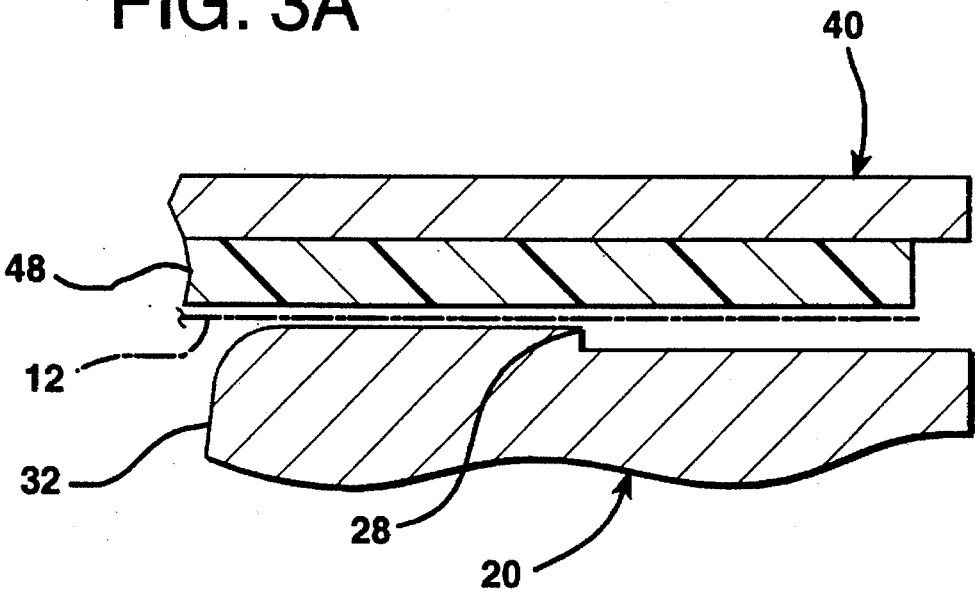
FIGS. 3A and 3B are detail views in cross-section of a pair of forming elements bending a representative foil material in accordance with the present invention.
Figure 3B:
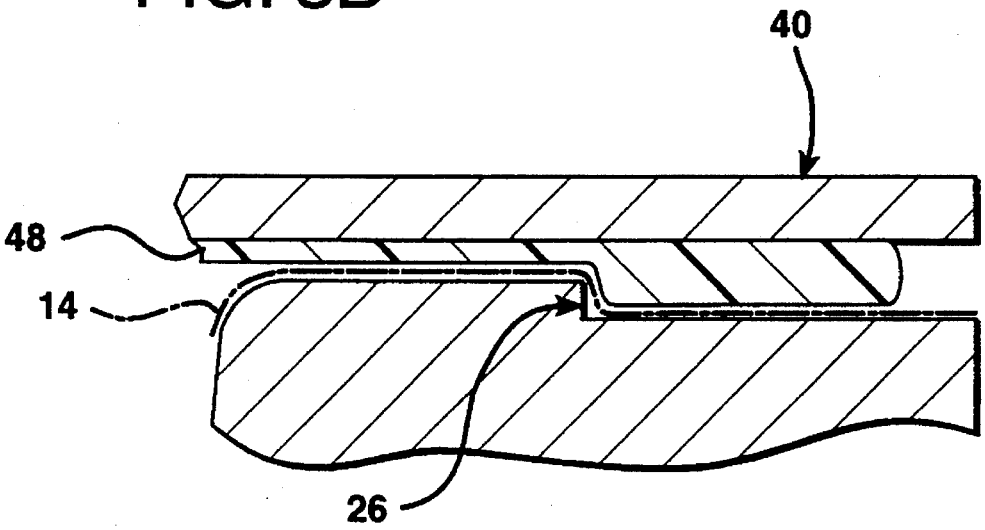

When the first and second forming elements 40, 20 are moved into clamping relationship, as shown in FIGS. 3A and 3B, a thin foil workpiece 12 placed between them is caused to bend over the edge 28 of the retaining step 26. At the moment of die closure the foil 12 is bent to the same sharp radius as the edge radius of the retaining step 26. This mechanical interlocking of the thin foil workpiece 12 with the second forming element 20 effectively reduces the clamping force required to control foil material slip. As excessive pressure is not required to retain the foil material, necessary material draw during forming is facilitated. As a result, substantially wrinkle-free flanges 16 remain in the formed article 14 as also shown in phantom (see FIG. 1).

As shown in the preferred embodiment of FIG. 1, the second forming element 20 includes a retaining step 26 which extends downward from the second clamping surface 22 and forms a generally sharp edge 28 therewith over which the thin foil workpiece 12 is bendable. In addition, the second forming element 20 further includes a land area 30 adjoining the retaining step 26 and extending outward therefrom. The second forming element land area 30 acts as a stop for clamping motion of the first and second forming elements 40, 20. Land area 30 further ensures good clamping action by the opposing portion of the first resilient and second clamping surfaces, 22, 44 while preventing premature damage to the first resilient surface 44 through overcompression by spreading increasing clamping force over a greater surface area.

Figure 2:
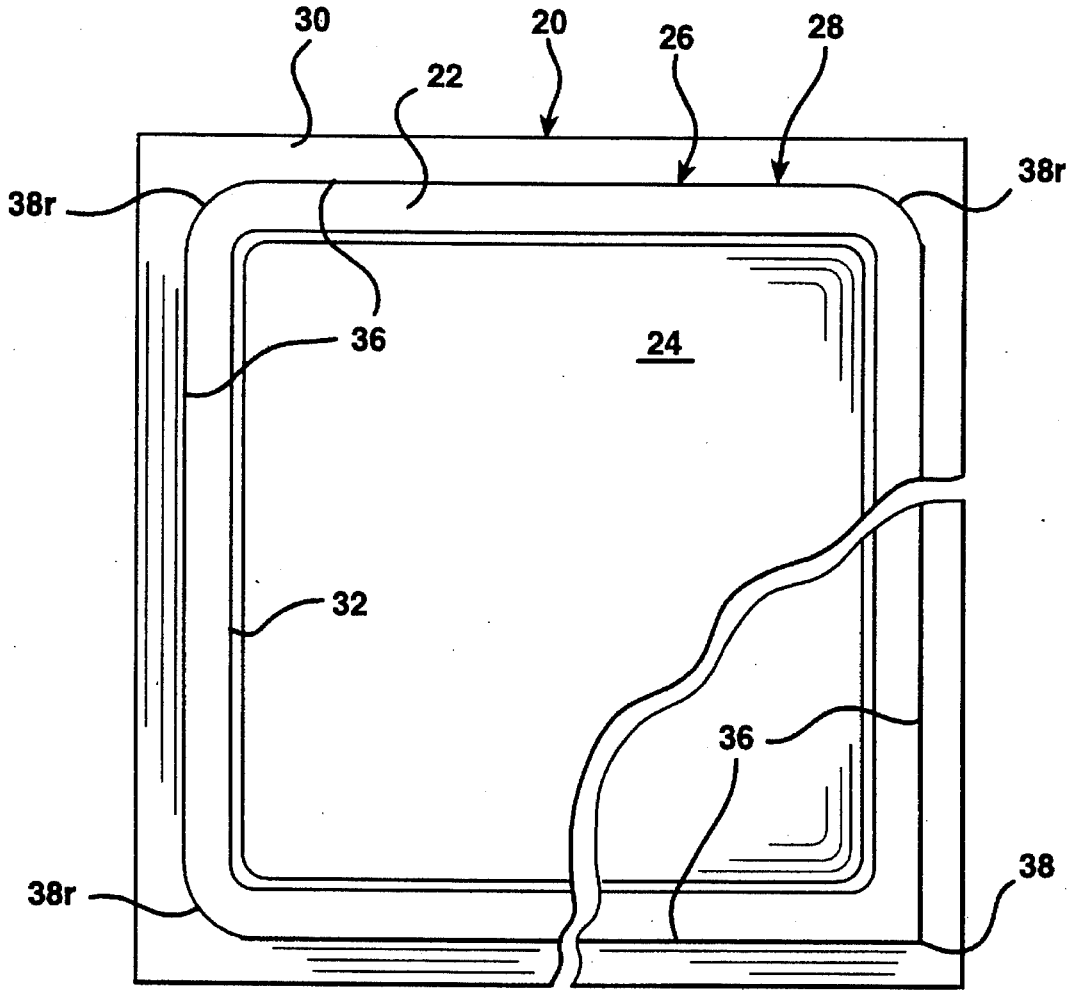
FIG. 2 is a schematic plan view of the second forming element in the preferred embodiment of the present invention shown in FIG. 1.

Referring to the plan view of FIG. 2, the retaining step 26 in the second forming element 20 of the present invention bounds the second clamping surface 22 with either radiused corners 38*r*, or sharper angled corners 38, as shown. Where sharper angled corners 38 are used, more foil material is present in the resulting flange area 16 of a workpiece 12 for welding at the corners of the thin foil workpiece 12. Thus, sharper angled corners 38 are preferred. Nonetheless, all sharp convex surfaces of the retaining step 26 must have radiuses duly designed to prevent tearing the foil material during bending and forming along its length. It is further preferable, although not mandatory in practicing the invention, that the second clamping surface 22 be defined by the retaining step 26 with a generally uniform width, as shown in FIG. 2, so that the resulting forces on and in the foil material are generally evenly distributed. Such geometry will also produce flanges 16 of generally uniform width.

Unlike many processes, in accordance with the present invention, the thin foil workpiece 12 need not be trimmed along sides or corners from its original shape before forming. All that is required is that about 0.65 cm (0.25 in) or more of thin foil material extend beyond the edge 28 of the retaining step 26.

Referring again to FIG. 1, the forming cavity 24 of the second forming element 20 also may be seen to include a transition surface 34 extending to the second clamping surface 22. The transition surface 34 preferably includes a low friction finish, by machining, polishing or low friction coating, to enhance the limited movement of foil material when it is drawn into the cavity 24 during forming along the corner radius near second clamping surface 22.

In addition, in the preferred embodiment, the first resilient surface 41 is a generally planar sheet 48 of elastomer. The sheet 48 is preferably large enough that when the first and second forming elements 40, 20 are brought into clamping relationship, the sheet 48 extends in all directions beyond the retaining step 26, as shown in FIGS. 3A and 3B. Use of an elastomeric material for the first resilient surface 41 makes possible relaxation of the dimensional tolerances of the first and second forming elements 40, 20. Rather than requiring expensive, highly planar metal clamping surfaces, slight irregularities in the second clamping surface 22 are tolerated by the resiliency of the first resilient surface 41. Tool costs for the first and second forming elements 40, 20 are thereby reduced from those required for matched metal clamping. In addition, where the first resilient surface 41 is a planar sheet of elastomer 48, the alignment of the first and second forming elements 40, 20 is not critical.

The elastomeric sheet 48 may be comprised of many suitable elastomeric materials, such as polyurethane, natural or synthetic rubber, filled cork, and other resilient materials having good hardness, preferably 70–90 durometer, Shore A. The particular elastomer may vary depending on the foil material being formed, the applied pressures, and the need for plastic movement of the foil material in and near the first resilient surface 41 and second clamping surface 22. As a result, some trial and error may be required to identify the optimum elastomer material type for the elastomeric sheet 48 to be used in applying the teachings of the present invention to a particular foil material. Polyurethane has been found to be the most desirable elastomer for use with stainless steel foils (e.g. 201 and 304 stainless foils) having a thickness less than about 0.0254 cm (0.010 in), as presented in more detail in the example set forth below.

Generally, however, polyurethane is preferred as an elastomer for many reasons. It exhibits a lower coefficient of friction when compressed against most metals; it is more perfectly elastic, and has good recovery when compressed over the edge 28 of retaining step 26, displaying little hysteresis; it tolerates high compressive forces without damage; it is cut resistant; it can be tailored to desired hardness values, and is sufficiently hard that it prevents wrinkles from forming by buckling of material up into the surface. Thus, while the retaining step 26 limits movement of the thin foil workpiece 12, a resilient material, such as the elastomer, polyurethane, permits desired material slip at high pressures desired for forming without wrinkling or tearing.

The thickness and softness of the first resilient surface 41 is limited, however. Where the thickness is great, or a soft resilient material is used (e.g. thick, 50–60 durometer rubber), high clamping forces which produce high pressures between the first resilient surface 41 and the workpiece surface also cause bi-directional movement of the resilient material. Such bi-directional movement includes flow of the elastomer material towards the edges and corners of the first resilient surface 41. As a result, lateral forces are applied to the workpiece material, causing the thin foil workpiece 12 to tear.

The elastomeric material used in first resilient surface 41 preferably has a thickness approximately two to five times the height, h, of the retaining step 26, but can be greater or smaller than this range depending on its particular characteristics and the needs of a particular application. For example, useful thicknesses of polyurethane have been found in the range of from about 0.15 cm (0.06 in) to 1.27 cm (0.50 in), with approximately 0.3175 cm (0.125 in) thick material preferred. Where a resilient material or an elastomer of this preferred size is used, the retaining step 26 is preferably in the range of 0.0762 cm (0.03 in) to 0.127 cm (0.05 in) high.

Figure 4:
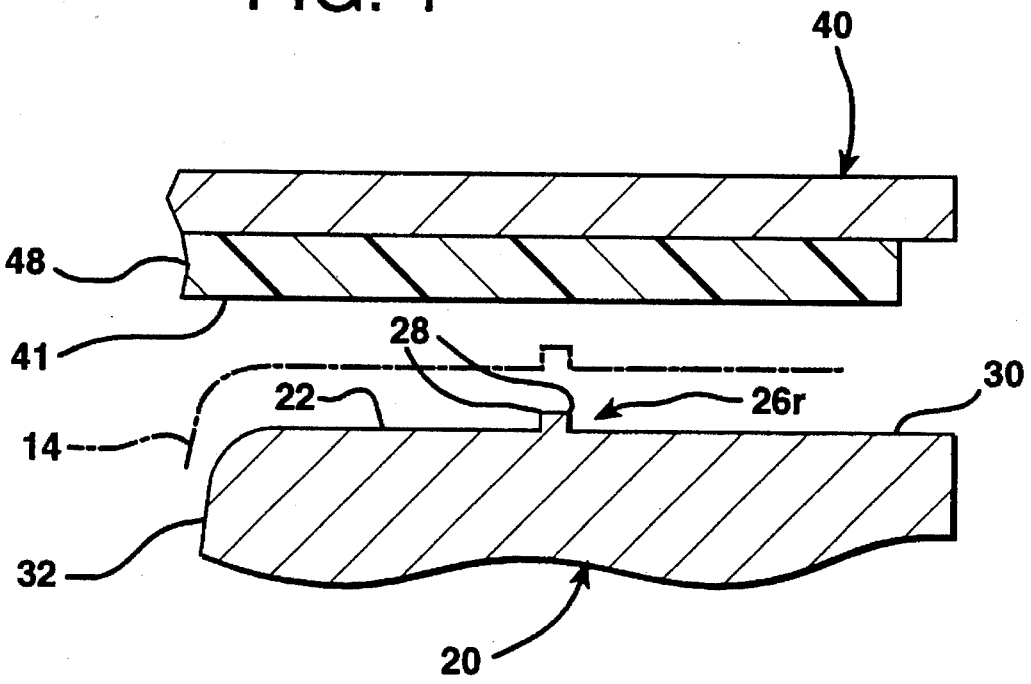
FIG. 4 is a detail view in cross-section of a pair of forming elements in a first alternative embodiment bending a representative foil material in accordance with the present invention.
Figure 5:
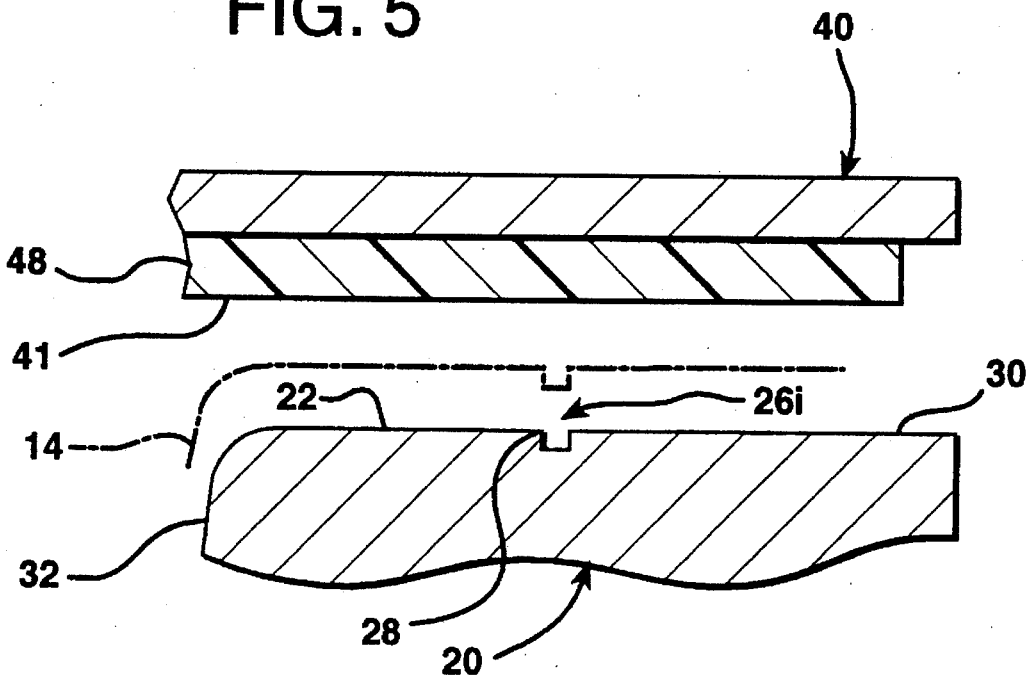
FIG. 5 is a detail view in cross-section of a pair of forming elements in a second alternative embodiment bending a representative foil material in accordance with the present invention.

Referring now to FIGS. 4 and 5, two alternative embodiments of the retaining step 26 are shown in exploded views which achieve the desired bending of the thin foil material to control movement of the workpiece 12, and allow reduced clamping pressures in the flange area 16 of the thin foil workpiece 12. As well, in both alternative embodiments a land area 30 extends outward from the alternative retaining step. The extensive second clamping surface 22 and land area 30 prevent overcompression of the elastomer. However, in both alternative configurations where the land area is at the same or higher level as the second clamping surface, higher total clamping forces are required to achieve the same level of compression of the workpiece 12 required to prevent wrinkling of the flange area 16.

Referring to FIG. 4, in the first alternative embodiment the retaining step is seen to be a narrow projection **26*p*, such as a ridge, machined into the second forming element 20 and bounding the second clamping surface 22. A multiple bend over the narrow projection 26*p* results when the first and second forming elements 40, 20 are brought into clamping relationship. However, in addition to the need for higher total clamping forces, the drawback of this alternative is that more foil material is used to bend the thin foil workpiece up and over the narrow projection 26*p*, which reduces the amount of available flange area inside the narrow projection 26*p*. Narrow projection 26*p* could be a different shape than shown. In the extreme an o-ring extending from a groove could serve as a narrow projection 26*p*. However, the desired sharper radius of edge 28 desired for bending the foil material would be lacking, and the desired function of retaining step 26** would be greatly reduced.

Referring to FIG. 5, in the second alternative embodiment the retaining step is seen to be a surface indentation **26*i*, such as a generally straight-sided groove, which is preferred in this alternative. The surface indentation 26*i* bounds the second clamping surface 22. The thin foil material of workpiece 12 is bent over the edge 28 of indentation 26*i*, as shown, by compression of the first resilient surface 41. However, in addition to the need for higher total clamping forces, the drawback to indentation 26*i*** is that bending the foil therein is less than optimum due to the geometry of the groove. Moreover, as the indentation is recessed, tooling costs are increased due to the time-consuming machining needed to produce an indentation such as a groove.

Further alternative embodiments are within the scope of the present invention, which is described in its preferred embodiment herein. By way of example, in accordance with an alternative embodiment, the land area 30 may be on the same plane or raised closer to the first forming element 40 than the clamping surface 22. Corresponding thereto, the first resilient surface may be shaped to include an indented portion in opposing relation with the raised land area 30. The raised land area 30 and indented portion of the first resilient surface (not shown) could also receive and spread higher clamping forces over the land area 30 to prevent overpressurization of the first resilient surface in like fashion with the preferred embodiment. However, this configuration is not preferred as it requires additional material costs, such as machining the resilient surface, and introduces the need for more precise, more costly alignment between the first and second forming elements 40, 20. Further, unlike the preferred embodiment wherein the first resilient surface requires no precise alignment, and can be shifted to spread wear and avoid compression set, the alignment required in the alternative embodiment will cause the first resilient surface to have a shorter useful service life.

By way of illustration, and not limitation, the present invention may be applied to forming a pan shape of foil material, as set forth in the following example using the preferred embodiment of FIGS. 1–3B.

EXAMPLE

In this illustrative example, pans were formed of 201 and 304 stainless steel foil material less than 0.0254 cm (0.010 in) thick, and in a preferred range of 0.0051 cm (0.002 in) to 0.0127 cm (0.005 in) in thickness. Thin foil workpieces 12 of 0.0076 cm (0.003 in) thickness have been repeatedly formed in accordance with the present invention. An open tray or pan shape approximately 26.7 cm (10.5 in) square having flanges 16 was formed in first and second forming elements 40, 20, as shown in FIGS. 1 and 2. The first resilient surface 41 was made of a sheet 48 of elastomer, to wit polyurethane, 85 durometer, Shore A, tensile strength grade 7500 psi, and having a thickness of 0.3175 cm (0.125 in). The retaining step height, h, was 0.1016 cm (0.040 in) high, which was large relative to the foil thickness. As seen in FIG. 2, the retaining step 26 had generally straight sides 36 with curved corners 38*r* having a radius of approximately 3.3 cm (1.30 in). A land area 30 was included having a width of approximately 1.78 cm (0.700 in) adjacent the straight sides 36 of the retaining step 26. The forming cavity 24 further included a transition surface 34 having a radius of 0.38 cm (0.15 in) between the second clamping surface 22 and the face 32 of the forming cavity 24. The face 32 is at approximately 10 degrees from vertical, widening towards the open end of the forming cavity 24 for easier removal of the formed thin foil workpiece 14 after forming. Any of several forming methods may be performed in accordance with this example, including rubber pad and hydroforming methods. Preferred is the method disclosed in related, co-pending U.S. patent application Ser. No. 008/238,991, filed May 6, 1994, entitled Method and Apparatus for Pneumatic Forming of Thin Foil Materials, by Hall, et al., commonly owned and assigned as to the same assignee of the present invention, and incorporated herein by reference.

Thin foils less than 0.0076 cm (0.003 in) thickness may be formed in accordance with the present invention. Foils of such thickness are preferably fully annealed foil material. Where such thin foils are used, the second clamping surface 22 must have high planarity, increasing tooling costs. Nonetheless, the present invention may be practiced with even such thin foils materials.

Referring again to FIGS. 1–5 and related discussion, the first and second forming elements 40, 20 may be made of aluminum, steel, or other suitable die materials for a particular application. Chrome plating may be added for durability at areas of high wear. However, due to the reduced clamping forces applied in the first resilient surface 41 and second clamping surfaces 22. It is believed that wear in the first and second forming elements 40, 20 in accordance with the present invention will be much less than that commonly encountered with matched metal dies.

Movement of the first and second forming elements 40, 20 into and out of opposing and clamping relationship may be performed by any one of numerous conventional press or clamping devices, whose type is not critical to the present invention. In addition, the particular forming operation which is used to form the thin foil workpiece after clamping in accordance with the present invention may include any of the conventional methods, such as rubber pad forming and hydroforming, and some stamping methods. It is preferred to practice the present invention in accordance with the method of forming disclosed in related, co-pending U.S. patent application Ser. No. 08/238,991, filed May 6, 1994, entitled Method and Apparatus for Pneumatic Forming of Thin Foil Materials, by Hall, et al., incorporated by reference above.

In a further aspect of the present invention, a method for forming thin foil material into shapes having generally wrinkle-free flange surfaces is provided. In accordance therewith, a pair of opposing first and second forming elements 40, 20 are provided as generally described above. The second forming element 20 has a second clamping surface 22 to receive a thin foil workpiece 12, a forming cavity 24 bounded by the second clamping surface 22, and a retaining step 26 defining the outer boundary of the second clamping surface 22. The retaining step 26 has an edge 28 over which the thin foil workpiece 12 is bendable. The first forming element 40 has a first resilient surface 41. Referring to FIG. 1, the method includes the steps of positioning a thin foil workpiece 12 between the first resilient surface 41 and second clamping surface 22 such that the thin foil workpiece 12 extends generally beyond the outer boundary of the second clamping surface 22, and moving the forming elements 40, 20 into opposing relationship. As shown in FIGS. 3A and 3B. The method next calls for applying clamping force to the first resilient surface 41 and second clamping surface 22, compressing portions 44 of the first resilient surface 41 in generally opposing relationship with the second clamping surface 22, and bending portions of the thin foil workpiece 12 over the edge 28. The method continues by maintaining the thin foil workpiece 12 against slippage during forming, in part by retaining the bent portions 18 of the thin foil workpiece 12 against the retaining step 26. Stated in another way, as the first resilient surface 41 is compressed by the second clamping surface 22, the portions 46 of the first resilient surface 41 which extend beyond the retaining step 26 apply force needed to bend the thin foil workpiece 12 over the edge 28. As forming proceeds, the step 28, in part, is engaged by the bent portions 18 of the foil, and retains the thin foil workpiece 12 against slippage. Thus, it may be understood that the steps of compressing portions 44 of the first resilient surface 41, and bending portions 18 of the thin foil workpiece 12 may be performed generally simultaneously.

In accordance with the method, by virtue of engaging the bent portion 18 of the thin foil workpiece 12 against the retaining step 26, the clamping pressure needed to retain the thin foil workpiece 12 against slippage during forming is reduced. The first resilient surface 41 is therefore able to perform the primary function of providing sufficient clamping pressure to preventing wrinkling, rather than being required to both restrain foil movement and prevent wrinkles. Generally wrinkle-free flanges 16 result in the formed thin foil workpiece 14.

Where the second forming element 20 further includes a land area 30 adjoining the retaining step 26 extending outward therefrom in generally opposing relationship to portions 46 of the first resilient surface 41, the step of applying clamping force includes spreading the clamping force over a larger surface area, including both the second clamping surface 22 and the land area 30. In this regard, it is further understood that the step of applying clamping force and spreading the clamping force is preferably performed sequentially, first applying clamping force to opposing portions 44 of the first resilient surfaces 41 and second clamping surfaces 22, and then applying clamping force to opposing portions 46 of the upper elastomeric clamping surface 41 and the land area 30. Regardless, contact with the land area during clamping reduces the increases in clamping force to the opposing portions of the first resilient surface 41 and second clamping surface 22 by spreading it over a larger surface area.

In accordance with the present invention, it is understood that the clamping force applied (typically in tons) to the first and second forming elements 40, 20 need not be as critically or precisely controlled as in other methods due to the limiting action of the land area 30. The reduced need for precision control permits use of lower cost pressing or clamping equipment. It may be further understood that use of the retaining step 26 allowing reduced clamping forces, optional use of the land area 30, and proper selection of material for first resilient surface 41 for desired material slip, permits high quality parts having wrinkle-free flanges to be produced more cost-effectively with lower cost tooling and procedures.

While certain representative embodiments and details have been shown for purposes of illustrating the invention, it will be apparent to those skilled in the art that various changes in the method and devices disclosed herein may be made without departing from the scope of the invention, which is defined in the appended claims.

We claim:

1. A pair of forming elements for forming a foil workpiece comprising:

a second forming element having:

a second clamping surface to receive a foil workpiece;

a forming cavity bounded by said second clamping surface;

a retaining step defining the outer boundary of said second clamping surface and having an edge over which a foil workpiece is bendable; and a first forming element having a first resilient surface shaped such that when said first and second forming elements are in opposing relationship portions of said first resilient surface are in opposing relationship with portions of said second clamping surface, and portions of said first resilient surface extend outward beyond said retaining step;

whereby moving said first and second forming elements into clamping relationship forces a foil workpiece to bend over said step, which step, in part, retains said foil workpiece against slippage during forming, permitting reduced clamping pressure between said first resilient surface and second clamping surface.

2. The forming elements of claim 1 wherein said retaining step extends downward from said second clamping surface and forms a generally sharp edge therewith over which a foil workpiece is bendable.

3. The forming elements of claim 1 wherein the second forming element further includes a land area adjoining the retaining step and extending outward therefrom.

4. The forming elements of claim 1 wherein the first resilient surface includes at least a portion of an elastomeric sheet having a first thickness.

5. The forming elements of claim 4 wherein the retaining step has a step height measured from said second clamping surface which is less than the first thickness of said elastomeric sheet.

6. The forming elements of claim 5 wherein the step height is less than the first thickness of said elastomeric sheet by a factor in the range of approximately 2 to approximately 5.

7. The forming elements of claim 4 wherein the first resilient surface comprises a generally planar elastomeric sheet extending in all directions outward beyond said retaining step.

8. The forming elements of claim 1 wherein:

said retaining step extends downward from said second clamping surface and forms a generally sharp edge therewith over which a foil workpiece is bendable;

wherein the second forming element further includes a land area adjoining the retaining step and extending outward therefrom.

9. The forming elements of claim 8 wherein:

the first resilient surface includes at least a portion of an elastomeric sheet having a first thickness; and the retaining step has a step height measured from said second clamping surface which is less than the first thickness of said elastomeric sheet.

10. The forming elements of claim 8 wherein said land area is spaced further from said first forming element than said second clamping surface.

11. The forming elements of claim 8 wherein said retaining step extends upward from said land area.

12. The forming elements of claim 1 for workpiece thicknesses of stainless steel having a thickness of generally 0.0254 cm or less, wherein:

the first resilient surface comprises at least a portion of an elastomeric sheet having a first thickness;

the second forming element further includes a land area adjoining the retaining step, and extending outward therefrom in generally opposing relationship with portions of said first resilient surface, said land area disposed downward from said second clamping surface;

said step extends downward to said land area defining a step height less than the first thickness of said elastomeric sheet and in the range of 0.0762 cm to 0.127 cm; and said elastomeric sheet has a first thickness in the range of approximately 2 to approximately 5 times the height of the retaining step.

13. A method for forming foil material into shapes comprising the steps of:

providing opposing forming elements including a second forming element having a second clamping surface to receive a foil workpiece, a forming cavity bounded by said second clamping surface, and a retaining step defining the outer boundary of said second clamping surface, said retaining step having an edge over which a foil workpiece is bendable, and a first forming element having a first resilient surface;

positioning a foil workpiece between said first resilient surface and said second clamping surface such that said foil workpiece extends generally beyond the outer boundary of said second clamping surface;

moving said first and second forming elements into opposing relationship;

applying clamping force to said first resilient surface and second clamping surfaces, compressing portions of said first resilient surface in generally opposing relationship with said second clamping surface, and bending portions of said foil workpiece over said edge; and maintaining said thin foil workpiece against slippage during forming in part by retaining said bent portions of said foil workpiece against said retaining step;

thereby reducing clamping pressure needed to retain said workpiece against slippage during forming.

14. The method of claim 13 wherein:

said step of providing includes providing a second forming element in which said retaining step extends downward from said second clamping surface and forms a generally sharp edge therewith over which a foil workpiece is bendable; and said steps of compressing portions of said first resilient surface, and bending portions of the foil workpiece are performed simultaneously.

15. The method of claim 13 where:

said step of providing further includes providing a second forming element further having a land area adjoining the retaining step and extending outward therefrom in generally opposing relationship to portions of said first resilient surface; and said step of applying clamping force includes spreading said clamping force over a larger surface area including said second clamping surface and said land area;

thereby reducing increases in clamping force in the opposing portions of the first resilient surface and second clamping surfaces.

16. The method of claim 15 wherein:

the step of providing includes providing a land area positioned further from said first forming element than said second clamping surface; and the step of applying clamping force and spreading said clamping force is performed sequentially, first applying clamping force to portions of said first resilient surfaces and second clamping surfaces in opposing relationship, and then applying clamping force to portions of said first resilient surfaces and said land area in opposing relationship.

17. The method of claim 13 wherein:

said step of providing includes:

providing a second forming element wherein said retaining step extends downward from said second clamping surface and forms a generally sharp edge therewith over which a foil workpiece is bendable; and providing a second forming element further having a land area adjoining the retaining step and extending outward therefrom in generally opposing relationship to portions of said first resilient surface; and said step of applying clamping force includes:

first, applying clamping force to said first resilient surface and second clamping surface, compressing portions of said first resilient surface, and bending portions of the foil workpiece; and thereafter, further applying clamping force and compressing portions of said first resilient surface in opposing relationship with said land area;

thereby reducing increases in clamping force in the opposing portions of the first resilient surface and second clamping surfaces.

18. The method of claim 13 wherein said step of positioning a workpiece comprises positioning a thin foil workpiece.

19. The method of claim 13 wherein said step of positioning a workpiece comprises positioning a workpiece of stainless steel having a thickness less than 0.0254 cm.

20. The method of claim 13 wherein said step of providing comprises providing a retaining step of from approximately 0.0762 cm to 0.127 cm in height, and providing an elastomeric sheet whose thickness is in the range of approximately 2 to approximately 5 times the height of the retaining step.

* * * * *